US006607324B2

(12) United States Patent
Choi

(10) Patent No.: US 6,607,324 B2
(45) Date of Patent: Aug. 19, 2003

(54) VARIABLE LENGTH PENCIL

(76) Inventor: Man Su Choi, Hyundai Apt. 301-502, Sa-Dong, Ansan-Shi, Kyungki, Do (KR)

( * ) Notice: Subject to any disclaimer, the term of this patent is extended or adjusted under 35 U.S.C. 154(b) by 0 days.

(21) Appl. No.: 10/299,755

(22) Filed: Nov. 18, 2002

(65) Prior Publication Data

US 2003/0095825 A1 May 22, 2003

(30) Foreign Application Priority Data

Nov. 20, 2001 (KR) ..... 2001-0072321

(51) Int. Cl.[7] ..... A46B 15/00; B43K 24/12; B43K 24/00

(52) U.S. Cl. ..... 401/55; 401/82; 401/99; 401/117

(58) Field of Search ..... 401/55, 82, 117, 401/99

(56) References Cited

U.S. PATENT DOCUMENTS

| | | | | | |
|---|---|---|---|---|---|
| 544,609 | A | * | 6/1895 | Boman | 401/55 |
| 1,865,325 | A | | 6/1932 | MacLeod | |
| 1,967,301 | A | * | 7/1934 | Ferris et al. | 401/55 X |
| 4,778,300 | A | | 10/1988 | French et al. | 401/55 |
| 6,022,161 | A | | 2/2000 | Choi | 401/99 |

* cited by examiner

*Primary Examiner*—Gregory L. Huson
*Assistant Examiner*—Kathleen J. Prunner
(74) *Attorney, Agent, or Firm*—Schmeiser, Olsen & Watts LLP

(57) ABSTRACT

A makeup pencil is made variable in length by use of rack shafts and a pinion. The pencil has three housings which interact to extend the brush when in use. The brush is projected out of one of the housings through a through-hole. The pencil structure has a flexible piece which seals the inside of the pencil over the through-hole when the pencil is not being used in order to prevent penetration of foreign materials in the air such as powder and dust into the pencil.

5 Claims, 8 Drawing Sheets

VARIABLE LENGTH PENCIL

BACKGROUND OF THE INVENTION

1. Field of the Invention

The present invention relates to a pencil, and more particularly, to a variable length pencil structure, which seals the inside of a pencil before using the pencil in order to prevent penetration of foreign materials in the air such as powder and dust into the pencil.

2. Description of the Related Art

Well known to those skilled in the art, a pencil used for makeup is taken in custody with its leading end being capped so that a brush in the leading end may not be exposed to powder or dust in the air.

However, since the pencil is separately provided with the cap, using the pencil requires an additional operation to remove the cap causing inconvenience to a user.

Further, if the cap is lost, the brush is exposed to the dust in the air. When this brush is kept in a handbag, there is a probability that the brush contacts with the inner surface of the handbag thereby contaminating the inside of the handbag.

In order to solve such a problem, Korean Patent Application Laid-Open No. 1998-72127 discloses a variable length pencil which exposes a brush through an opening of the pencil while placing the brush inside the pencil before using the pencil.

Although such a variable length pencil is excellent in an effect of varying the length of the pencil, however, the foreign materials may penetrate into the pencil through the opening in the lower end of the pencil resultantly leaving a probability that the brush contained within the pencil can be exposed to the dust.

SUMMARY OF THE INVENTION

Accordingly, the present invention has been made to solve the foregoing problems and it is an object of the present invention to provide a variable length pencil structure which seals the inside of a pencil before using the pencil in order to prevent penetration of foreign materials in the air such as powder and dust into the pencil.

According to an aspect of the invention to obtain the above object, it is provided a variable length pencil comprising: a vertically opened rectangular inner housing; a power transmission unit fixedly provided inside the inner housing and having a rectangular body, a gear-receiving section of a certain width inside the body, a pinion rotatably provided by fixing means inside the gear-receiving section, with the gear-receiving section having both opened sides for outwardly exposing both sides of the pinion received in the gear-receiving section, guides provided at both sides of the body to oppose each other along the entire length thereof, wherein the both opened sides of the gear-receiving section respectively correspond to the guides; a first outer housing for sliding on the inner housing while contacting with the outside thereof; a head unit having a head fixed to one end of the first outer housing, a rack shaft inside thereof for cooperating with the power transmission unit and a flexible piece provided at a leading end of the rack shaft; a second outer housing fixedly provided around a lower end of the inner housing and having a closed lower end and a through hole in the closed lower end; and a movable unit movably provided inside the inner housing and having a rack shaft extended in a position opposed to the rack shaft of the head unit for cooperating with the power transmission unit and a fixed portion provided at a lower end for being exposed out of the second outer housing, wherein the rack shaft of the head unit and the rack shaft of the movable unit are respectively guided by the guides of the power transmission unit.

Preferably, the invention may further comprise: a guide member provided inside the second outer housing by coupling with the same, wherein the guide member has a guide at one side for guiding the flexible piece in a longitudinal direction and a lower end which is rounded to readily curve the flexible piece, whereby the flexible piece is readily moved and curved.

According to the invention, it is preferable that the power transmission unit is made of an elastic material and has incisions at upper both sides to impart flexibility to the upper both sides so that the power transmission unit is elastically supported to the inner wall of the inner housing.

Preferably, the invention may further comprise: a projection at the leading end of the rack shaft of the head unit, wherein the flexible piece is attached to the projection.

Also according to the invention, it is preferable that the second housing is rounded at a lower end of the inner wall thereof to readily curve the flexible piece toward the through hole of the second outer housing.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

The following detailed description will present a preferred embodiment of the invention in reference to the accompanying drawings.

Figure 1:
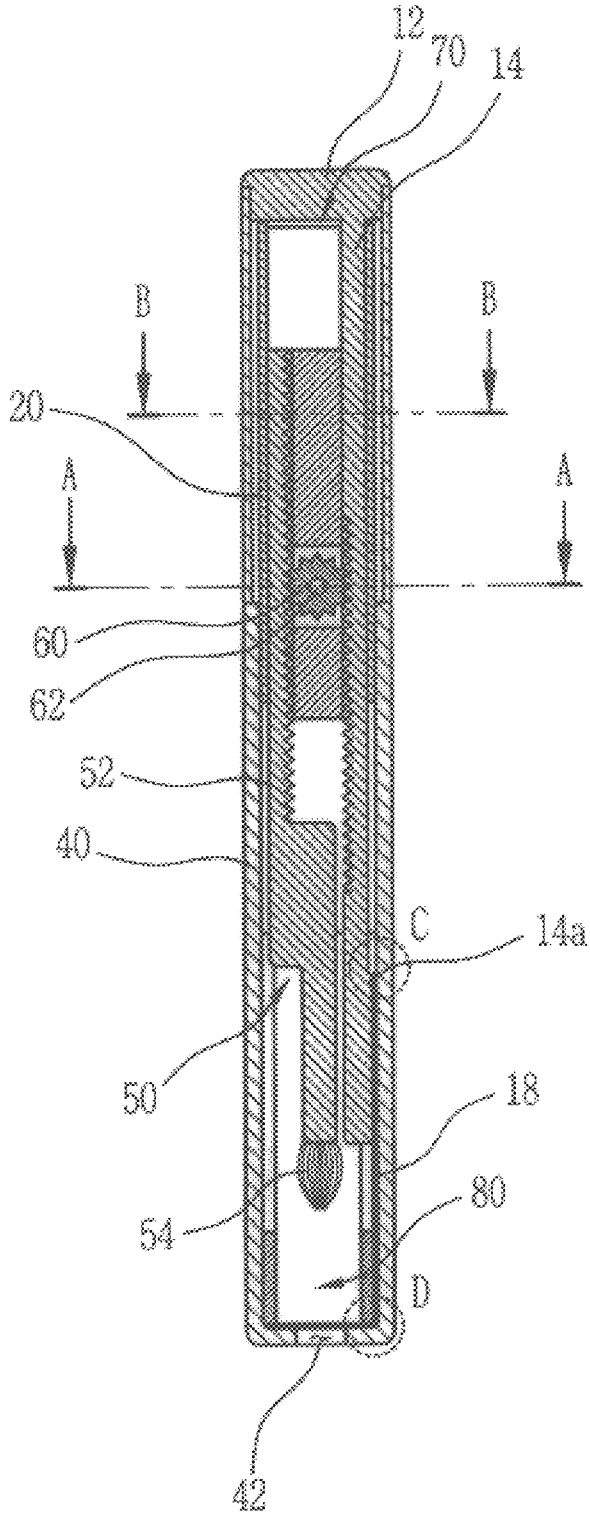
FIG. 1 is a longitudinal sectional view illustrating a variable length pencil of the invention before it is used.
Figure 2:
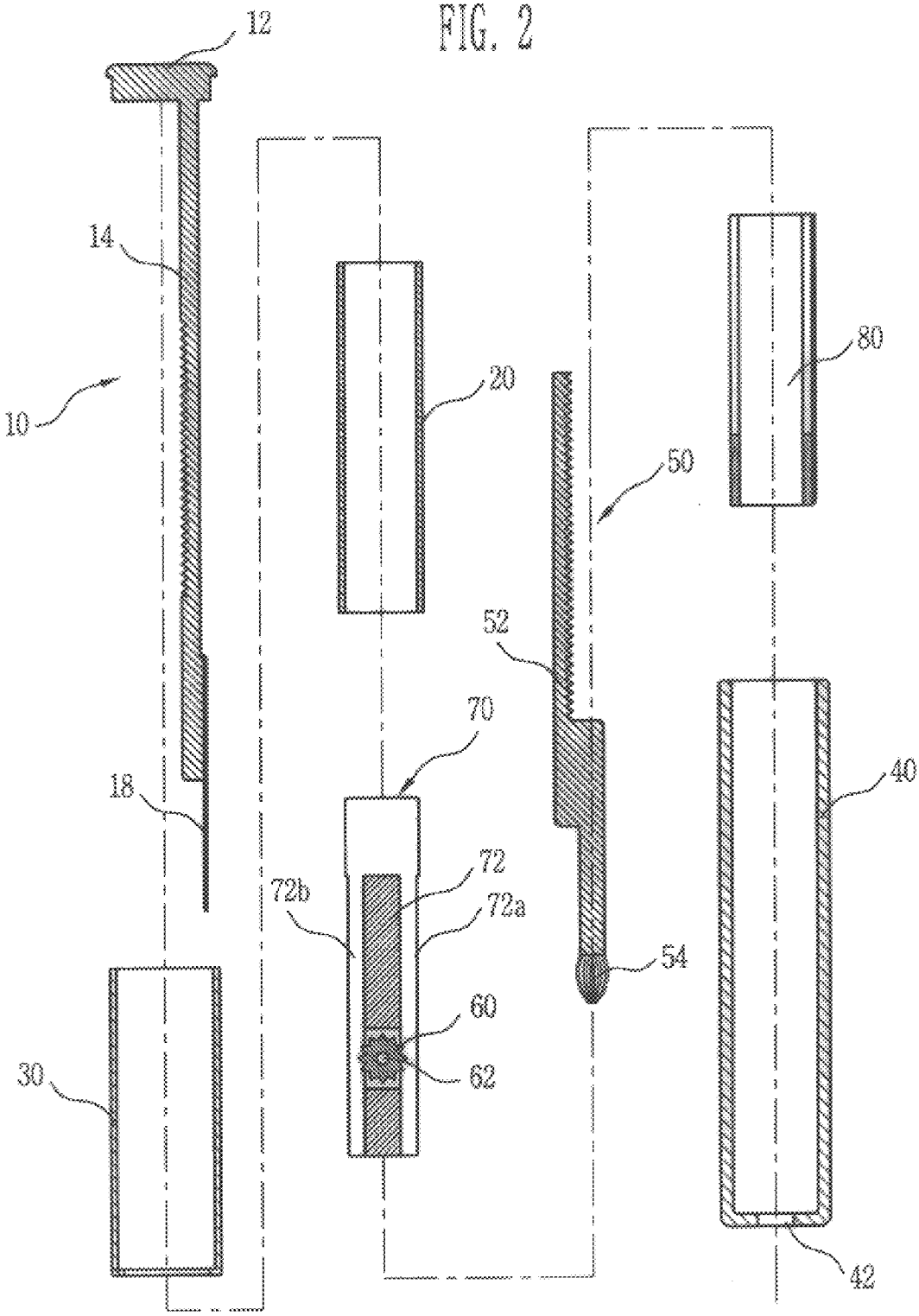
FIG. 2 is an exploded sectional view of the variable length pencil of the invention.

FIG. 1 is a longitudinal sectional view illustrating a variable length pencil of the invention before it is used, and FIG. 2 is an exploded sectional view of the variable length pencil of the invention. The variable length pencil of the invention is constituted of a rectangular inner housing 20, the first and second outer housings 30 and 40 respectively arranged around the upper and lower portions of the inner housing 20, a power transmission unit 70 fixedly installed inside the inner housing 20, a head unit 10 fixedly installed in the upper portion of the inner housing 20 and a movable unit 50 moving inside the second outer housing 40.

Figure 3:
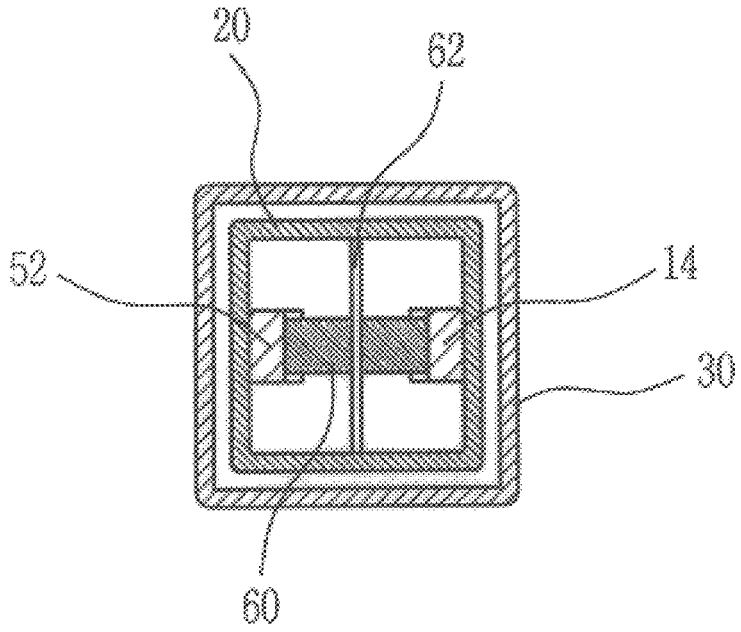
FIG. 3 is a sectional view along a line A—A in FIG. 1.
Figure 4:
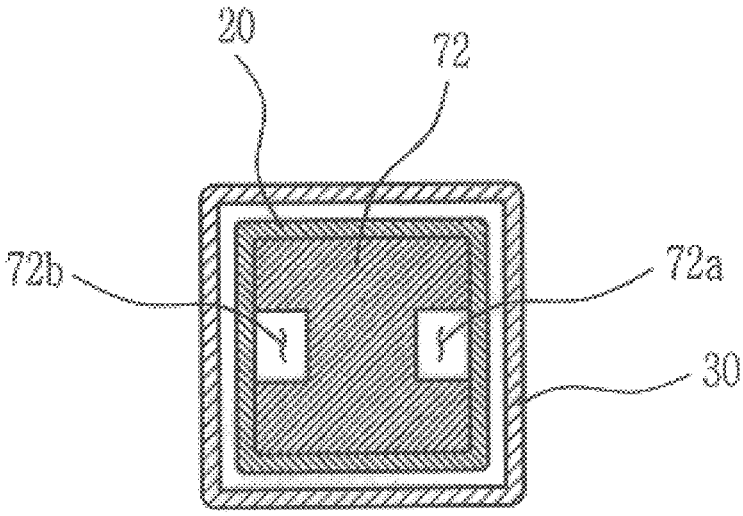
FIG. 4 is a sectional view along a line B—B in FIG. 1.
Figure 7:
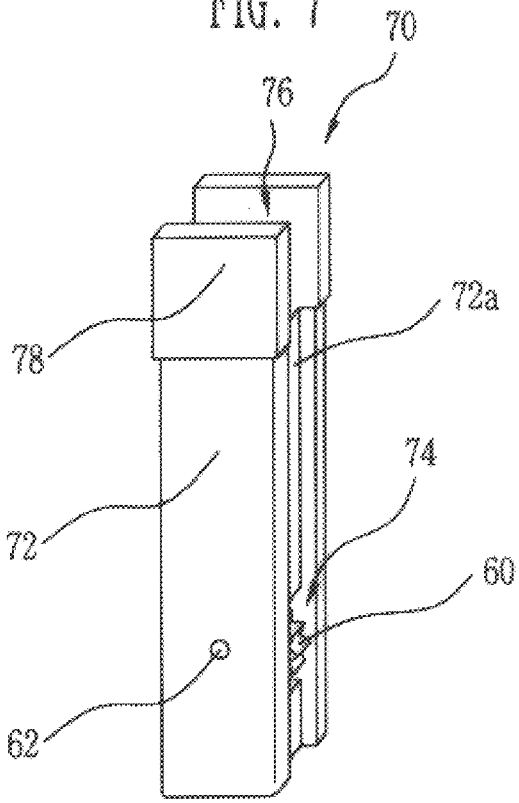
FIG. 7 is a perspective view illustrating a power transmission unit of the variable length pencil of the invention.

The first housing 30 is so mounted vertically slidable in respect to the inner housing 20 while contacting with the outside of the inner housing 20. Further, within the inner housing 20 is mounted the power transmission unit 70. FIG. 7 is a perspective view of the power transmission unit 70, and FIGS. 3 and 4 are sectional views illustrating the installed position thereof.

The power transmission unit 70 is constituted of a box-shaped body 72 and a pinion 60 rotatably mounted by fixing means such as a pin 62 within the body 72. Describing this in more detail, inside the body 72 is formed a gear-receiving section 74 with a predetermined width in which the pinion 60 is rotatably mounted by the fixing means such as the pin 62.

Further, the gear-receiving section 74 has opened portions at both sides thereof so that both sides of the received pinion 60 are outwardly exposed through the opened portions. In the meantime, the body 72 is provided at both sides with guides 72*a* and 72*b* opposing each other along the entire length thereof. The both opened sides of the gear-receiving section 74 respectively correspond to the guides 72*a* and 72*b* so that those portions of the pinion 60 exposed through the opened portions are projected from the bottoms of the guides 72*a* and 72*b* as shown in FIG. 3.

In the meantime, as specifically shown in FIG. 7, the power transmission unit 70 is composed of an elastic material and has slits 76 at opposite upper portions. As the remaining portions at both sides of the incisions 76 have flexibility, the power transmission unit 70 is elastically supported to the inner wall of the inner housing 20.

Further, in the upper portion of the power transmission unit 70 are provided projections 78 so that the power transmission unit 70 can be fixed to the inner housing 20 without any separate fixing means after the power transmission unit 70 is inserted into the inner housing 20. Further, at one end of the first outer housing 30 is preferably provided a fixing protrusion so that the projections 78 are caught to the first outer housing 30 to prevent the first outer housing 30 from being separated or detached from the inner housing 20.

In the upper end of the first outer housing 30 is fixedly installed the head unit 10. The head unit 10 has a head 12 and the first rack shaft 14 integrally extending downward from the head 12 for a predetermined length. The first rack shaft 14 extends through the first outer housing 30 to mesh with a portion of the pinion 60 of the power transmission unit 70 installed within the inner housing 20 so as to provide vertical transport movement.

That is to say, when the first outer housing 30 is coupled with the inner housing 20, the first rack shaft 14 is placed within the guide 72*a* formed at one side of the body 72 constituting the power transmission unit 70 while a portion of the first rack shaft 14 is meshed with an exposed portion of the pinion 60 mounted within the gear-receiving unit 74 of the power transmission unit 70.

The second outer housing 40 and the inner housing 20 are fixedly attached to each other at their ends, and the movable unit 50 is received within the second outer housing 40. The brush 54 is fixed to the lower end of the movable unit 50, and the second rack shaft 52 is extended from the upper end of the movable unit 50. When the second outer housing 40 receiving the movable unit 50 is fixedly coupled with the inner housing 20, the second rack shaft 52 of the movable unit 50 is placed within the guide 72*b* in the body 72 of the power transmission unit 70 to mesh with an exposed portion of the pinion 60 mounted within the gear-receiving section 74 of the power transmission unit 70.

As shown in FIG. 1, the first rack shaft 14 fixed to the head unit 10 and the second rack shaft 52 fixed to the movable unit 50 are opposed to each other in respect to the pinion 60 of the power transmission unit while mesh with each other in respect to the pinion 60 so that the rack shafts 14 and 52 carry out their transport movements in the opposite direction to each other. The rack shafts 14 and 52 are respectively received within the guides 72*a* and 72*b* of the body 72 constituting the power transmission unit 70 so that each of the rack shafts 14 and 52 can be transported within the guides 72*a* and 72*b* to carry out correct linear transport.

Figure 5:
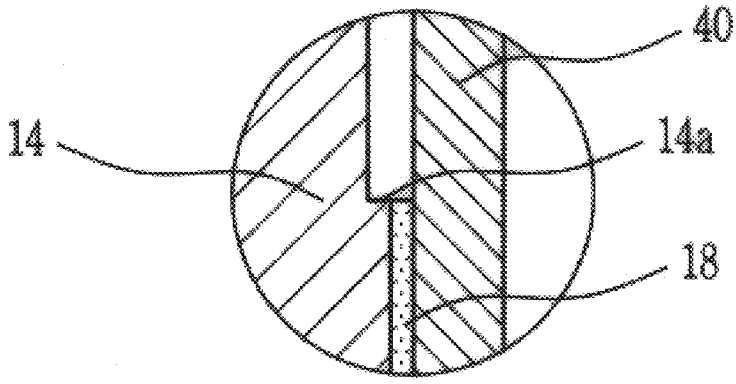
FIG. 5 is a magnification illustrating a region C in FIG. 1.

As shown in FIGS. 1 and 2, in the leading end of the first rack shaft 14 of the head unit 10 is installed a flexible piece 18. The flexible piece 18 is made of a flexible material to naturally curve when the leading end thereof contacts with a blind end having a through hole 42 of the second housing 40. Further, as shown in FIG. 5, the first rack shaft 14 is provided with a projection 14*a* at a portion of the leading end thereof to which the flexible piece 18 is attached so that the elastic piece 18 closely contacts with the inner wall of the second outer housing 40 as well as the transport movement of the first rack shaft 14 imparts smooth sliding and inflection to the flexible piece 18.

The projection 14*a* permits the flexible piece 18 to further closely contact with the inner wall of the second outer housing 40 to enable smooth sliding. Further, when the movable unit 50 is drawn out as the first outer housing 30 slidingly contacts with the outside of the inner housing 20, the projection 14*a* is caught by the end of the inner housing 20 to prevent separation or detachment between the first outer housing 30 and the inner housing 20 due to excessive transport.

Figure 6:
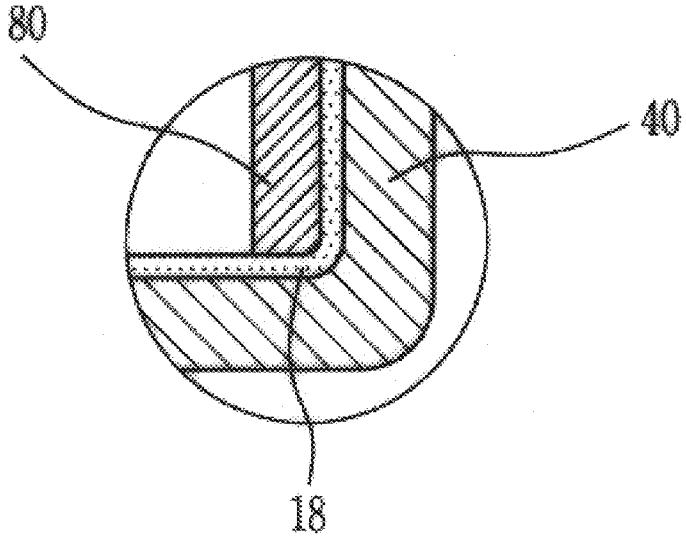
FIG. 6 is a magnification illustrating a region D in FIG. 1.

In the meantime, as shown in FIG. 6, lower edges of the second outer housing 40 are rounded so that the flexible piece 18 moves toward the through hole 42 of the second outer housing 40.

Although the flexible piece 18 opens/closes the through hole 42 like this, it is preferred to add a guide member 80 for the purpose of a smooth opening/closing operation of the through hole 42. Such a guide member 80 is specifically shown in FIGS. 1, 2 and 8.

As can be seen from FIGS. 1 and 2, the guide member 80 is mounted inside the second outer housing 40 by coupling with the inner periphery thereof.

Figure 8:
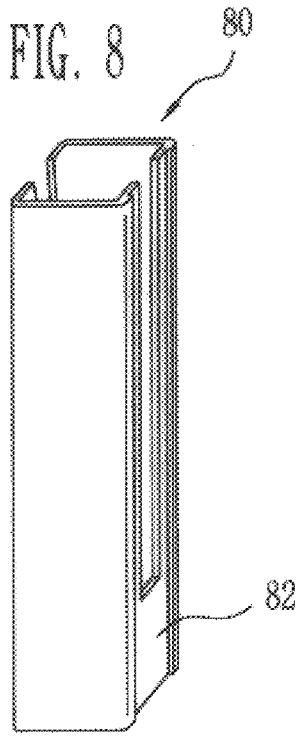
FIG. 8 is a perspective view illustrating a guide member of the variable length pencil of the invention.

Further, FIG. 8 is a perspective view illustrating the guide member 80. As can be seen from FIG. 8, the guide member 80 is provided with a guide 82 in the longitudinal direction at one side, and rounded at the end of the guide 82.

Therefore, the flexible piece 18 is guided along the guide 82 of the guide member 80 without lateral transformation and its leading end is rounded to readily curve toward the closed end having the through hole 42 of the second outer housing 40.

Figure 9:
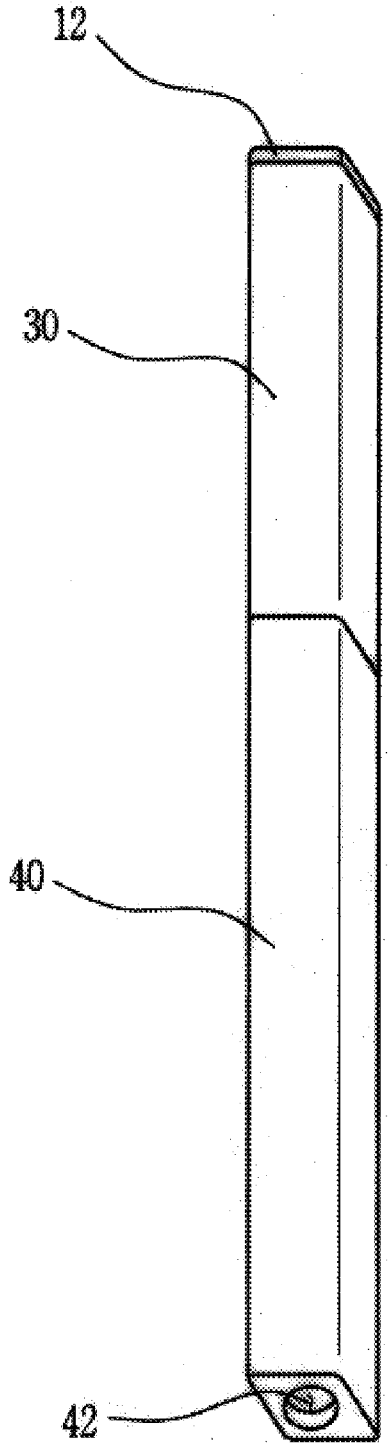
FIG. 9 is a perspective view illustrating the external appearance of the pencil of the invention before it is used.

In the meantime, FIG. 9 is a perspective view illustrating the external appearance of the pencil before it is used, in which the first outer housing and the second outer housing 40 closely contact with each other, and the through hole 42 of the second outer housing 40 is closed by the flexible piece 18.

Figure 11:
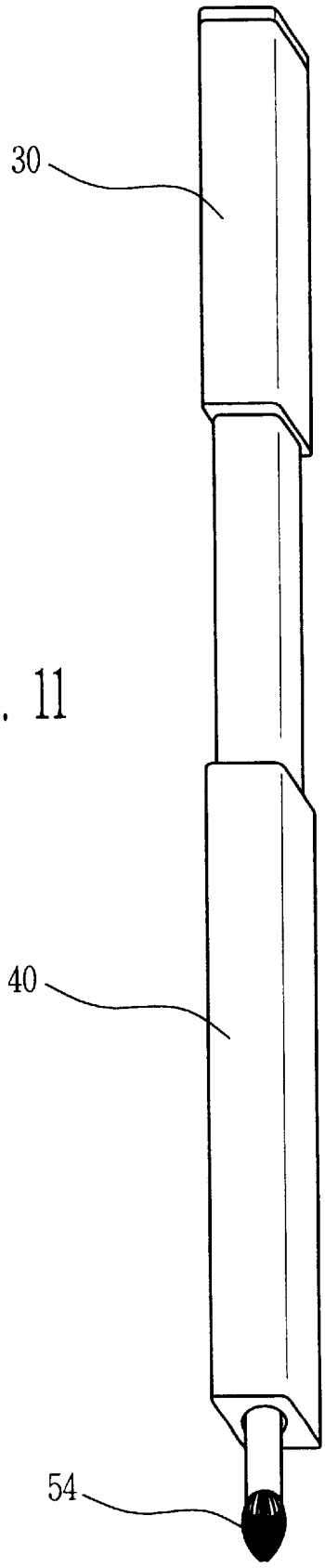
FIG. 11 is a perspective view illustrating the external appearance of the pencil of the invention in use.

Further, FIG. 11 is a perspective view illustrating the external appearance of the pencil in use, in which the first outer housing 30 is separated from the second outer housing 40 to increase the entire length of the pencil while projecting the brush 54 via the through hole 42 of the second outer housing 40.

A process of operating the invention constructed as above will be described in reference to the drawings as follows.

Figure 10:
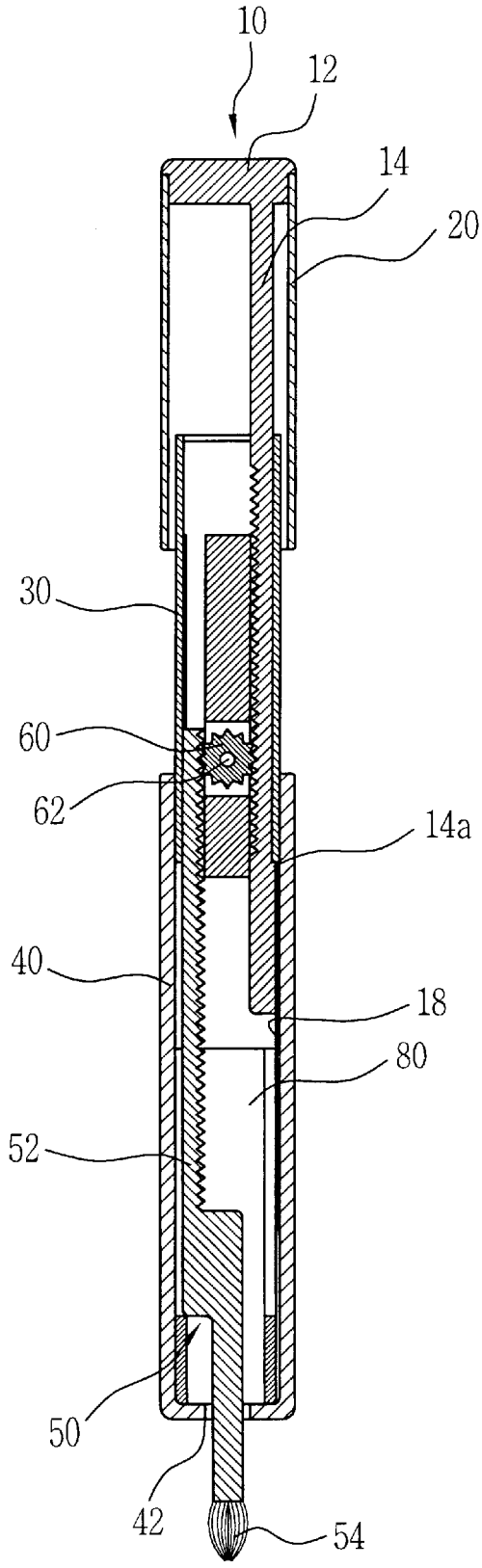
FIG. 10 is a longitudinal sectional view illustrating the pencil of the invention in use.

FIG. 1 is the longitudinal sectional view illustrating the variable length pencil of the invention before it is used, and FIG. 10 is the longitudinal view illustrating the variable length pencil of the invention in use.

As can be seen in the drawings, when the head 12 of the head unit 10 is drawn upward, the first outer housing 30 is transported by sliding for a predetermined length in the same direction along the inner housing 20.

Therefore, the first rack shaft 14 fixed to the end of the head 12 is moved upward, and the pinion 60 of the power transmission unit 70 is rotated with its one side being meshed with the first rack shaft 14.

Like this, as the pinion is rotated, the second rack shaft 52 of the movable unit 50 meshed with the other side of the pinion 60 is transported downward in a direction opposite to the transport direction of the first rack shaft 14 of the head unit 10.

Therefore, the movable unit 50 is transported downward within the second outer housing 40, and as a result, the brush 54 of the movable unit 50 is transported downward for a predetermined distance to outwardly expose itself.

At the same time, the flexible piece 18 installed in the first rack shaft 14 of the head unit 10 retreats along the guide 82 of the guide member 80 to reside within the guide 82.

The above operation is carried out just before the pinion 60 is released from each of the rack shafts 14 and 52 with which the pinion 60 is meshed or the projection 14*a* is caught by the inner housing 20.

As shown in FIG. 10, upon completion of drawing out the movable unit 50, the entire length of the pencil is increased as much as the transport distances of the rack shafts 14 and 52 added thereto.

After the pencil is used, an operation of placing the exposed brush 54 into the second outer housing 40 is carried out in a reverse manner as above.

That is, if the head 12 of the head unit 10 is pushed downward, the first outer housing 30 is transported downward as sliding on the inner housing 20. This causes the first rack shaft 14 to move downward, and through this operation, the pinion 60 of the power transmission unit 70 is rotated reversely in respect to the rotating direction thereof when the first rack shaft 14 moves upward.

Further, as the pinion 60 is rotated, the second rack shaft 52 of the movable unit 50 meshed with the other side of the pinion 60 is transported upward in a direction opposite to the first rack shaft 14 of the head unit 10. Therefore, the movable unit 50 is transported upward inside the second outer housing 40, and as a result, the brush 54 which was exposed outside the second outer housing 40 is received into the second outer housing 40.

At the same time, the flexible piece 18 attached to the leading end of the rack shaft 14 of the head unit 10 is moved along the guide 82 of the guide member 80 to close the through hole 42 in the lower end of the second outer housing 40.

In this case, the flexible piece 18 is readily curved since the inner lower end of the second outer housing 40 is rounded.

According to the variable length pencil of the invention as set forth above, the brush is outwardly exposed as the entire length of the pencil is increased, but as the entire length of the pencil is decreased, the brush is received into the pencil making the same compact and the flexible piece closes the through hole of the second outer housing to prevent any penetration of dust in the air into the pencil. Therefore, there is an effect of advantageously further enhancing the convenience of the pencil in use.

Also, the invention can prolong the life time of the pencil by preventing the brush within the pencil from being exposed to dust and the like.

Further, the invention prevents the pencil from directly contacting with the external air so that the brush may not be dried.

Therefore, the brush can be maintained in a suitable degree of wetness so that a user can have smooth feeling to the brush in use.

What is claimed is:

1. A variable length pencil comprising:

a vertically opened rectangular inner housing;

a power transmission unit fixedly provided inside said inner housing and having a rectangular body, a gear-receiving section of a predetermined width inside said body, a pinion rotatably provided by fixing means inside said gear-receiving section, with said gear-receiving section having two opposite opened sides for outwardly exposing both sides of said pinion received in said gear-receiving section, guides provided at both sides of said body to oppose each other along the entire length thereof, wherein said both opened sides of the gear-receiving section respectively correspond to said guides;

a first outer housing for sliding on said inner housing while contacting with the outside thereof;

a head unit having a head fixed to one end of said first outer housing, a rack shaft inside thereof for cooperating with said power transmission unit and a flexible piece provided at a leading end of said rack shaft;

a second outer housing fixedly provided around a lower end of said inner housing and having a closed lower end and a through hole in the closed lower end, the flexible piece is made of a material which naturally flexes when a leading end thereof contacts said lower end of said second outer housing to seal over the through hole; and a movable unit movably provided inside said inner housing and having a rack shaft extended in a position opposed to said rack shaft of the head unit for cooperating with said power transmission unit and a brush fixed at a lower end for being exposed out of said second outer housing, wherein said rack shaft of the head unit and said rack shaft of the movable unit are respectively guided by said guides of the power transmission unit.

2. The variable length pencil according to claim 1, further comprising: a guide member provided inside said second outer housing by coupling with the same, wherein said guide member has a guide at one side for guiding said flexible piece in a longitudinal direction and a lower end which is rounded to readily curve said flexible piece, whereby said flexible piece is readily moved and curved.

3. The variable length pencil according to claim 1, wherein said power transmission unit is made of an elastic material and has slits at the two opposite opened sides to impart flexibility to said sides so that said power transmission unit is elastically supported to the inner surface of said inner housing.

4. The variable length pencil according to claim 1, further comprising: a projection at the leading end of said rack shaft of the head unit, wherein said flexible piece is attached to said projection.

5. The variable length pencil according to claim 1, wherein said second outer housing has rounded corners at a lower end thereof to readily curve said flexible piece toward said through hole of the second outer housing.

* * * * *